US008806726B1

(12) United States Patent
Lo

(10) Patent No.: US 8,806,726 B1
(45) Date of Patent: Aug. 19, 2014

(54) PACIFIER CLIP

(71) Applicant: Tien Chung Ent. Co., Ltd., Taoyuan County (TW)

(72) Inventor: Chin-Tien Lo, Taoyuan County (TW)

(73) Assignee: Tien Chung Ent. Co., Ltd., Taoyuan County (TW)

( * ) Notice: Subject to any disclaimer, the term of this patent is extended or adjusted under 35 U.S.C. 154(b) by 0 days.

(21) Appl. No.: 13/900,505

(22) Filed: May 22, 2013

(51) Int. Cl.
*A45F 5/02* (2006.01)
*A61J 17/00* (2006.01)
*A44B 11/06* (2006.01)

(52) U.S. Cl.
CPC ..... *A44B 11/06* (2013.01); *A61J 2017/001* (2013.01); *A61J 17/00* (2013.01)
USPC ..... 24/516; 24/504; 24/3.12; 24/3.13

(58) Field of Classification Search
USPC ..... 24/516, 504, 3.11, 3.12, 3.13, 499, 513, 24/498, 515; 606/234
See application file for complete search history.

(56) References Cited

U.S. PATENT DOCUMENTS

| | | | | | |
|---|---|---|---|---|---|
| 867,655 | A * | 10/1907 | Gutmann | ..... | 24/516 |
| 4,141,119 | A * | 2/1979 | Nodo | ..... | 24/504 |
| 5,778,497 | A * | 7/1998 | Noda | ..... | 24/504 |
| 6,260,244 | B1 * | 7/2001 | Noda | ..... | 24/499 |
| 6,263,702 | B1 * | 7/2001 | Lo | ..... | 63/1.11 |
| 6,327,757 | B1 * | 12/2001 | Noda | ..... | 24/504 |
| 7,003,854 | B2 * | 2/2006 | Takabayashi et al. | ..... | 24/504 |
| 7,979,965 | B2 * | 7/2011 | Lo | ..... | 24/504 |
| 8,156,616 | B2 * | 4/2012 | Lo | ..... | 24/516 |
| 2012/0036682 | A1 * | 2/2012 | Lo | ..... | 24/3.12 |

* cited by examiner

*Primary Examiner* — Victor Batson
*Assistant Examiner* — Abigail Morrell
(74) *Attorney, Agent, or Firm* — Guice Patents PLLC

(57) ABSTRACT

The present invention relates to a pacifier clip, which comprises a base sheet, a mobile clipping member, a pulling member and a tying tool. When the pulling member is pulled, in the rotating motion, an angled flange of the pulling member utilizes an eccentric action to optionally allow an angled part or an inclined cutting plane of the angled flange to be abutted against or adjacent to an oblique support arm of the mobile clipping member, so a passive sheet of the mobile clipping member is downwardly moved or upwardly raised, and tooth rows of the passive sheet and tooth lines of the base sheet are engaged for forming a clipping status or forming a gap in between for forming a releasing status.

10 Claims, 7 Drawing Sheets

PACIFIER CLIP

BACKGROUND OF THE INVENTION

1. Field of the Invention

The present invention relates to a pacifier clip, especially to a safe pacifier clip that is strong in structure, easy in use and complies with safety regulations issued by many countries.

2. Description of Related Art

The motion of an infant sucking a pacifier is to give the infant the sense of comfort and security; especially when an infant wants to sleep but keeps crying and grumping, a pacifier is often served as a comforting means to put the infant into sleep; it is not rare that a pacifier is often out of sight while an infant was playing, so when the pacifier is needed and cannot be found in time, it may result in that the infant will cry or even have a temper therefore the infant is more difficult to be taken care of; various types of pacifier clips are invented by skilled people in the art for clipping a pacifier on the cloth worn by the infant, so the pacifier is prevented from being losing and this often provides a good outcome.

Take the safe pacifier clip (the U.S. Pat. No. 8,156,616, corresponding to Taiwan Patent NO. M367004 and The China Patent NO. 200920156358.8) granted to the applicant of the present invention for example, the safe pacifier clip comprises a base sheet, a pulling member, a latching member, a clamping member and a tying tool. A connecting sheet of the base sheet is formed with a first flange; a second flange of the latching member is disposed in the connecting sheet and adjacent to the inner surface of the first flange, and an opening at the bottom end of the cap-shaped clamping member is connected with the first and the second flanges which are in a stacking status, so arc-shaped clamping sheets provided at the front and the rear end clamp the two flanges. When the pulling member is pulled, a pressing sheet at the bottom end of the pulling member is optionally moved and positioned at a top or a bottom oblique surfaces of a block of the latching member, and the clamping member and the two arc-shaped clamping sheets connected to the two flanges release or store energy, so the clamping sheet of the latching member is outwardly raised for forming a releasing status or inwardly clamped for forming a clipping status.

The mentioned safe pacifier clip is able to overcome many disadvantages of a conventional pacifier clip, especially the connecting sheet and the first and the second flanges of the latching member are buckled and clamped by an elastic clamping member, thereby being prevented from bring released and also protected from being damaged by external forces, so advantages of strong in structure and anti-loosening are achieved. However, the installation of the clamping member would increase the assembling difficulty and procedure, so the production cost for pacifier clip is inevitably increased. Moreover, the pacifier clip is mostly used in an infant, and the clamping member is very likely to deform after being sanitized in high temperature, thereby being released from the first and the second flanges.

SUMMARY OF THE INVENTION

One primary objective of the present invention is to provide a pacifier clip, having advantages of securely clipping and releasing, simple in structure and easy in use, thereby reducing the assembling procedure and greatly reducing the production cost and enhancing the clipping effect.

For achieving the objective, one technical solution provided by the present invention is to provide a pacifier clip, which comprises:

a base sheet, the top surface thereof is protrudingly formed with a pair of sheet columns, an accommodation slot is formed between the pair of sheet columns, and the top end is axially connected to a shaft rod, the bottom end of the accommodation slot is axially formed with a shaft slot, and the rear end of the pair of sheet columns is formed with one or more tooth lines;

a mobile clipping member, formed as a step-shaped sheet member, two ends of an oblique support arm formed with a hook-like shape in the mid portion thereof are respectively connected to a pivotal shaft received in the shaft slot and a passive sheet, the bottom surface of the passive sheet is formed with one or more tooth rows corresponding to the locations where the tooth lines are formed; and the top surface of the oblique support arm is axially and protrudingly formed with at least two ribs, and a through slot is formed between two adjacent ribs, each of the through slots is radially and protrudingly formed with a stop piece connected to the pivotal shaft;

a pulling member, the top surface at the rear end thereof is axially formed with a rod slot sleeved with the shaft rod, the bottom ends at two sides of the rod slot are protrudingly formed with a pair of angled flanges interacting with the oblique support arm, wherein the distance between an angled part at the bottom end of the pair of angled flanges and the shaft rod is greater than the distance between an inclined cutting plane at the rear end of the pair of angled flanges and the shaft rod; the bottom surface of the pair of angled flanges are respectively formed with an angled stop tenon corresponding to each through slot and having a height higher than the pair of angled flange and penetrating into the through slot; and a tying tool, formed as an elongated member, one end thereof is fastened on the base sheet, the other end thereof is installed with a buckling ring;

when the pulling member is pulled, in the rotating motion, the angled flange utilizes an eccentric action to optionally allow the angled part or the inclined cutting plane of the angled flange to be abutted against or adjacent to the oblique support arm, so the passive sheet of the mobile clipping member is downwardly moved or upwardly raised, and the tooth rows of the passive sheet and the tooth lines of the base sheet are engaged for forming a clipping status or forming a gap in between for forming a releasing status; when the mobile clipping member is in the releasing status, each angled stop tenon is abutted against the stop piece in each through slot.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

As shown from FIG. 1 to FIG. 4, the pacifier clip provided by the present invention substantially comprises a base sheet 1, a mobile clipping member 2, a pulling member 3 and a tying tool 4.

Figure 1:
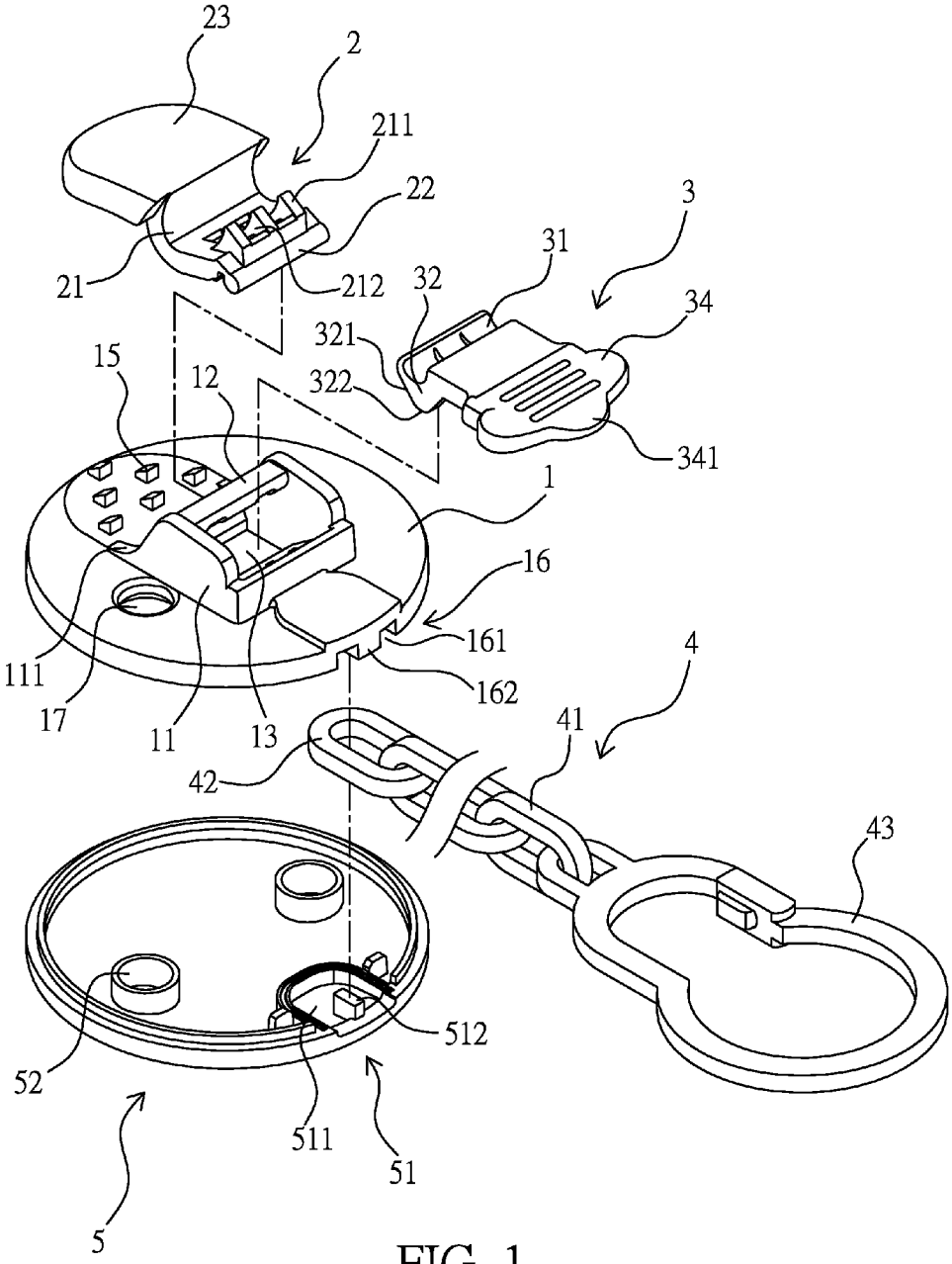
FIG. 1 is a perspective exploded view illustrating the pacifier clip according to the present invention.
Figure 2:
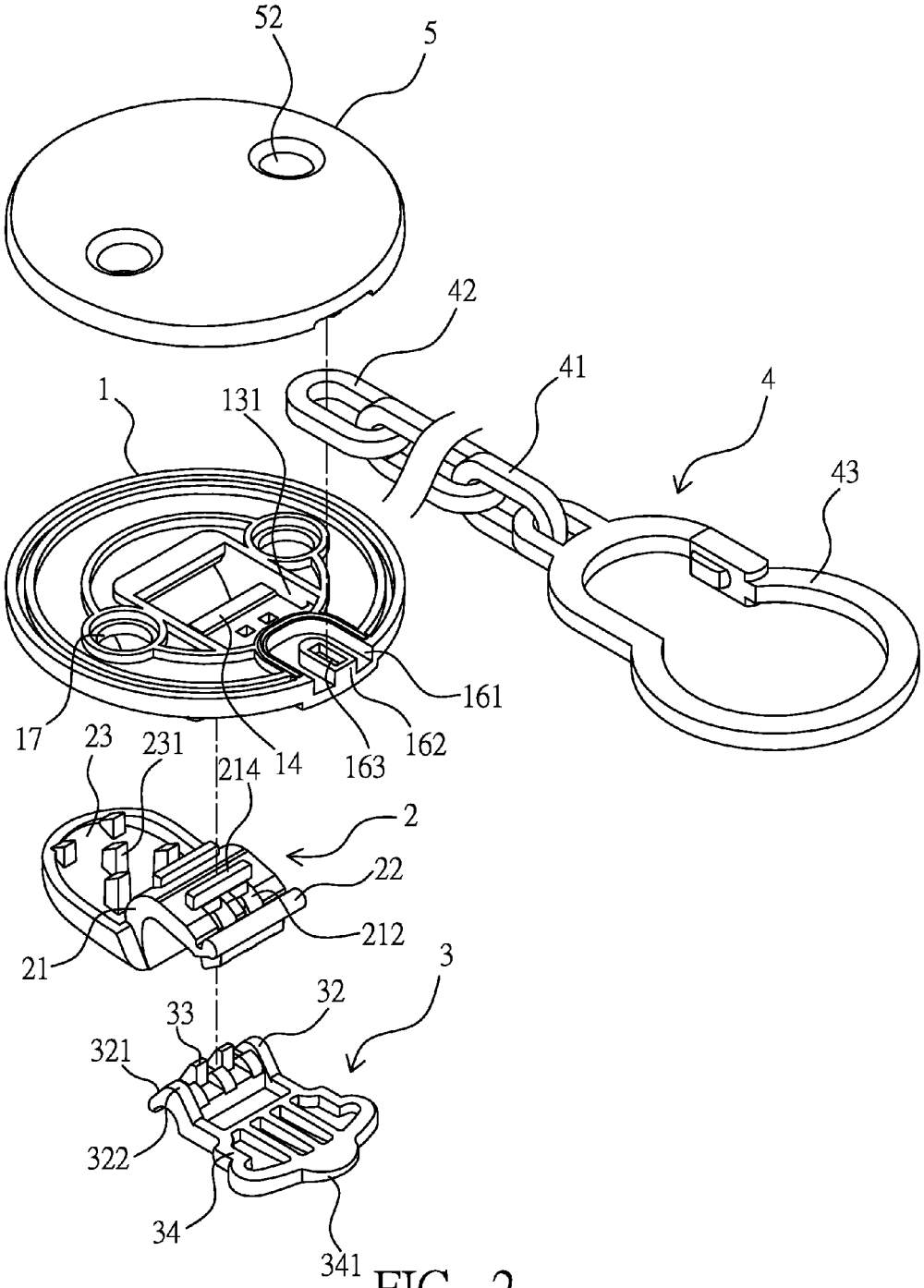
FIG. 2 is a perspective exploded view illustrating the pacifier clip being viewed from another angle according to the present invention.

The base sheet 1 is an integrally formed sheet member, which can be made in various geometrical shapes or doll-like shapes for achieving a better outlook. As shown in FIG. 1, the base sheet 1 is formed in a round shape, and the back surface thereof can be printed or laminated with plane patterns or directly glued with three dimensional objects.

Figure 4:
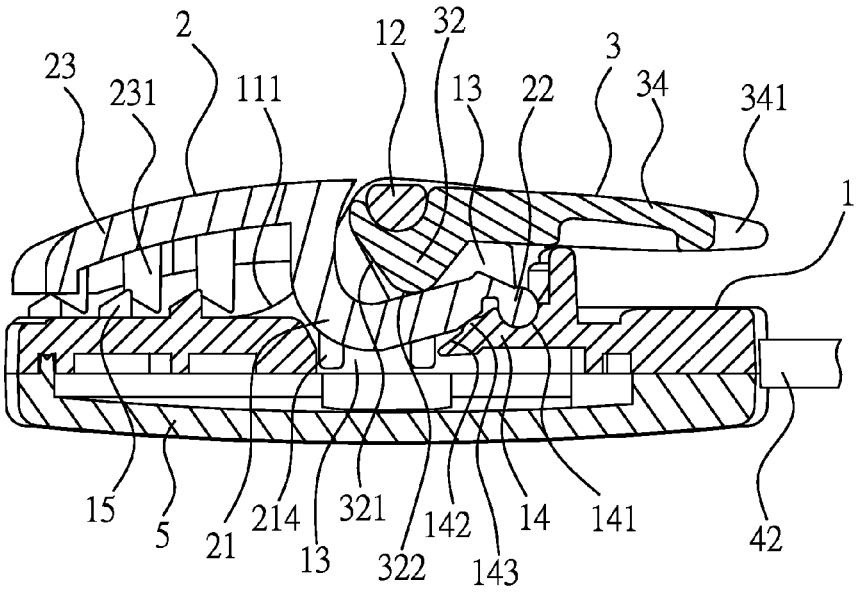
FIG. 4 is a partial cross sectional view illustrating the pacifier clip shown in FIG. 3.

The top surface of the base sheet 1 is protrudingly formed with a pair of sheet columns 11, the top end of the pair of sheet columns 11 is axially connected to shaft rod 12 having an arc-shaped bottom surface, wherein the installing location of the shaft rod 12 is preferably to be lower than the installing location of the pair of sheet columns 11, so in an impact test, the impact force is sustained by the pair of sheet columns 11 and the pulling member 3 for dispensing the impact force, the shaft rod 12 is protected from being broken so the operation safety is ensured. In addition, an accommodation slot 13 is formed between the pair of sheet columns 11, and the bottom surface of the accommodation slot 13 is backwardly and radially protruded with a bottom sheet 14, two lateral sides of the bottom sheet 14 and the pair of sheet columns 11 can be integrally combined, or two lateral sides of the bottom sheet 14 and the pair of sheet columns 11 are respectively formed with a slit 131, so the bottom sheet 14 is provided with a function of elastic deformation. Wherein, the top surface of the bottom sheet 14 is axially formed with a shaft slot 141, and one free end thereof is formed with an inclined plane 142 (as shown in FIG. 4), and the inclined plane 142 is formed with a protrusion 143 thereby enhancing the recovering elasticity when the mobile clipping member 2 is released. Moreover, the rear ends of the two sheet columns 11 are adjacently connected to one or more tooth lines 15.

Figure 3:
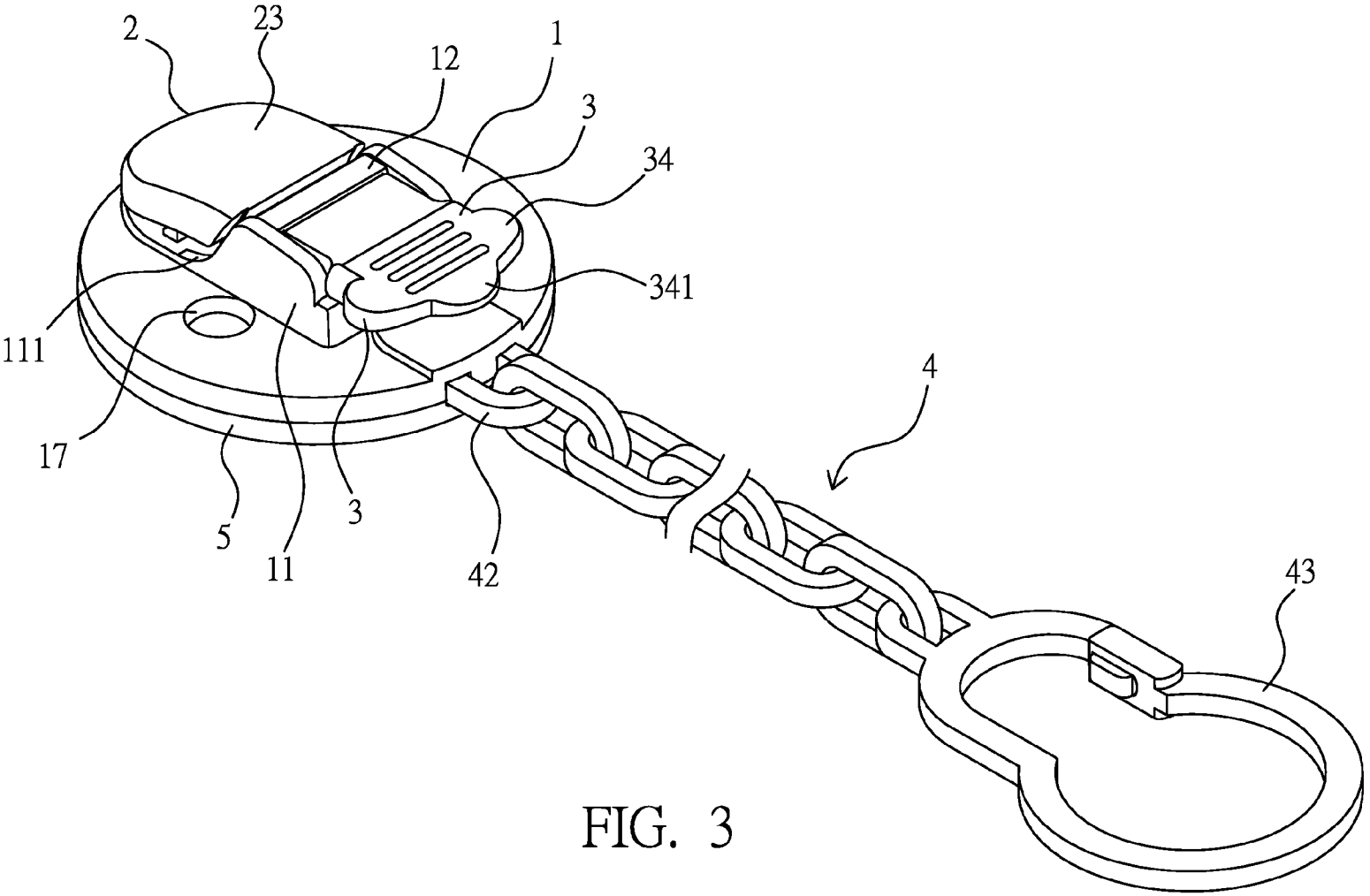
FIG. 3 is a perspective view illustrating the clipping status after the pacifier clip being assembled according to the present invention.

As shown in FIG. 3, a proper location at the back surface of the base sheet 1, e.g. the location where the front end edges of the pair sheet columns 11 are connected, is formed with a connection part 16 allowing the tying tool 4 to be connected, as shown in FIG. 1, the interior of the connection part 16 is formed with a positioning slot 161 allowing a ring unit 42 at the tail end of the tying tool 4 to be sleeved and a positioning tenon 162, and the bottom surface of the positioning tenon 162 is longitudinally formed with an insertion hole 163.

Furthermore, in order to provide the surface of the base sheet 1 with a better outlook and to shield the accommodation slot 13, the back surface of the base sheet 1 is provided with a decoration sheet 5 having the same dimension and style, after the decoration sheet 5 and the base sheet 1 are combined, an ultrasonic operation is processed for sealing the two. Wherein, the surface of the decoration sheet 5 can be printed or laminated with plane patterns or directly glued with three dimensional objects for achieving a better outlook and increasing the purchase willingness of consumers.

The top periphery of the decoration sheet 5 is formed with a complementary connection part 51 corresponding to the location where the connection part 16 is formed, the interior of the complementary connection part 51 is formed with a complementary positioning slot 511 allowing the ring unit 42 at the tail end of the tying tool 4 to be sleeved and an insertion tenon 512. When assembling the present invention, the ring unit 42 at the tail end of the tying tool 4 is firstly received between the positioning slot 161 and the positioning tenon 162 of the connection part 16; then the base sheet 1 and the decoration sheet 5 are combined, the ring unit 42 is also received in the complementary positioning slot 511, the insertion tenon 512 is inserted in the insertion hole 163 of the positioning tenon 162 thereby enabling the ring unit 42 to be positioned; lastly, decoration sheet 5 and the base sheet 1 are combined though an ultrasonic operation, so the combination of the base sheet 1, the decoration sheet 5 and the tying tool 4 is achieved.

In addition, proper locations on the base sheet 1 and the decoration sheet 5 can be respectively formed with penetrated ventilation holes 17, 52, in other words the base sheet 1 and the decoration sheet 5 are correspondingly formed with plural pairs of ventilation holes 17, 52, so when an infant accidentally swallows the pacifier, he/she is prevented from suffocating and more rescue time is obtained. Safety regulations for said incident have been established by many countries, therefore no further illustration is provided.

The mobile clipping member 2 is a step-shaped sheet member, two ends of an oblique support arm 21 formed with a hook-like shape in the mid portion thereof are respectively connected to a pivotal shaft 22 received in the shaft slot 141 and a passive sheet 23, the bottom surface of the passive sheet 23 is formed with one or more tooth rows 231 corresponding to the locations where the tooth lines 15 are formed thereby capable of correspondingly engaging with the tooth lines 15, or as shown in FIG. 4, the tooth rows 231 and the tooth lines 15 can be staggeringly arranged thereby capable of engaging with each other.

The top surface of the oblique support arm 21 is axially and protrudingly formed with at least two ribs 211, and a through slot 212 is formed between two adjacent ribs 211, each of the through slots 212 is radially and protrudingly formed with a stop piece 213 (shown in FIG. 7) connected to the pivotal shaft 22, the stop piece 213 is used for stopping an upward pulling motion of the pulling member 3, thereby preventing the pulling member 3 and the mobile clipping member 2 from separating. In addition, the bottom surface of the oblique support arm 21 is axially and protrudingly formed with a stop rib 214, when the stop rib 214 is in a clipping status, the stop rib 214 is abutted against the inner wall at the rear end of the accommodation slot 13 (as shown in FIG. 4), thereby preventing the clipped object, e.g. clothes, from being pulled, and preventing the pivotal shaft 22 of the mobile clipping member 2 from being radially released from the shaft slot 141 of the base sheet 1.

The pulling member 3 is a sheet member, the top surface at the rear end thereof is axially formed with a rod slot 31 sleeved with the shaft rod 12, the bottom ends at two sides of the rod slot 31 are protrudingly formed with a pair of angled flanges 32 interacting with the oblique support arm 21, wherein an inclined cutting plane 321 at the rear end of the pair of flanges 32 and an angled part 322 at the bottom end respectively form an eccentric status relative to the shaft rod 12 due to the distance difference, in other words the distance between the angled part 322 and the shaft rod 12 is greater than the distance between the inclined cutting plane 321 and the shaft rod 12. Moreover, the bottom surface of the pulling member 3 between the pair of flanges 32 includes an angled stop tenon 33 corresponding to each through slot 212 and having a height higher than the flange 32 and penetrating into each through slot 212, so when the pulling member 3 is upwardly pulled, each angled stop tenon 33 is abutted against the stop piece 213 in each through slot 212, thereby forming a limitation for the upward pulling motion of the pulling member 3 and also preventing the pulling member 3 and the mobile clipping member 2 from separating. The periphery of a pulling sheet 34 at the free end of the pulling member 3 is formed with an extending sheet 341 which is integrally extended towards outward, thereby enlarging the dimension of the pulling sheet 34 and facilitating the operation for users.

The tying tool 4 is an elongated member, one end thereof is fastened with the connection part 16 and the complementary connection part 51 preset at the periphery of the base sheet 1 and the periphery of the decoration sheet 5, the other end thereof is connected to a buckling ring 43, and the buckling ring 43 is further combined with a pacifier. Wherein, according to one embodiment of the present invention, the tying tool 4 is a chain 41, the ring unit 42 at the tail end thereof is connected with the connection part 16 and the complementary connection part 51 preset at the periphery of the base sheet 1 and the periphery of the decoration sheet 5, thereby allowing the chain 41 to be connected to the base sheet 1.

As shown in FIG. 3 and FIG. 4, when the pacifier clip is desired to be assembled, firstly the pivotal shaft 22 of the mobile clipping member 2 is inserted from the rear end of the accommodation slot 13 formed between the pair of sheet columns 11, and pivoted with the shaft slot 141, two sides of the passive sheet 23 at the other end are abutted against the inclined plane 111 at the rear end of the pair of sheet columns 11, and the tooth rows 231 protrudingly formed at the bottom surface are staggeringly engaged with the tooth lines 15 protrudingly formed on the top surface at the rear end of the base sheet 1; then the rod slot 31 of the pulling member 3 is inserted from the front end of the accommodation slot 13 formed between the pair of sheet columns 11, and pivoted with the shaft rod 12; the pulling sheet 34 is pressed in the clockwise direction to allow the stop tenon 33 at the bottom surface cross through the correspondingly-formed stop piece 213 and enter the through slot 212; and in the clockwise rotating motion, the condition of the angled flange 32 being against the oblique support arm 21 through the inclined cutting plane 321 is changed to the condition of the angled part 322 pressing the oblique support arm 21, and one bottom side of the oblique support arm 21 is abutted against the protrusion 143 of the inclined plane 142 at the free end of the bottom sheet 14, thereby forming an energy storing status, the stop rib 214 at the other side is adjacent to the inner wall at the rear end of the accommodation slot 13, thereby causing the pulling member 3 and the mobile clipping member 2 to be in the clipping status.

Figure 5:
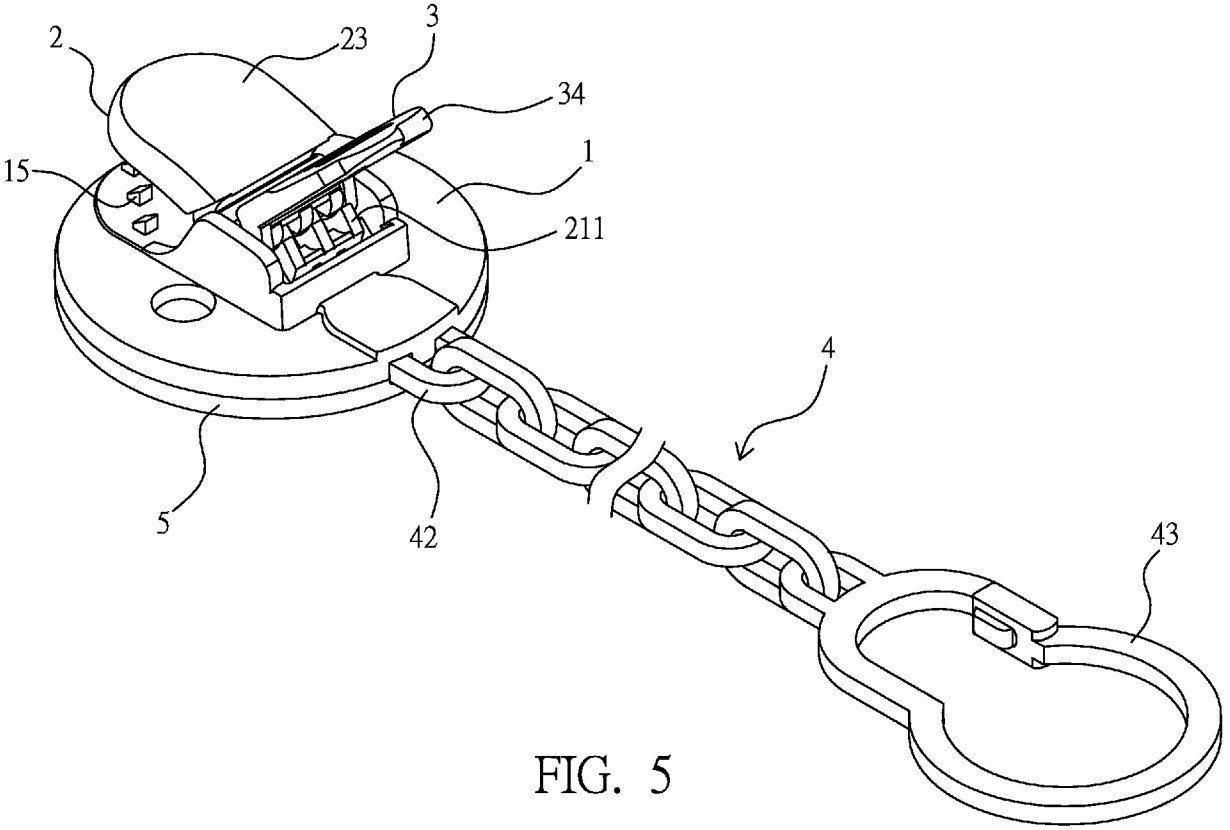
FIG. 5 is a perspective view illustrating the releasing status after the pacifier clip being assembled according to the present invention.
Figure 6:
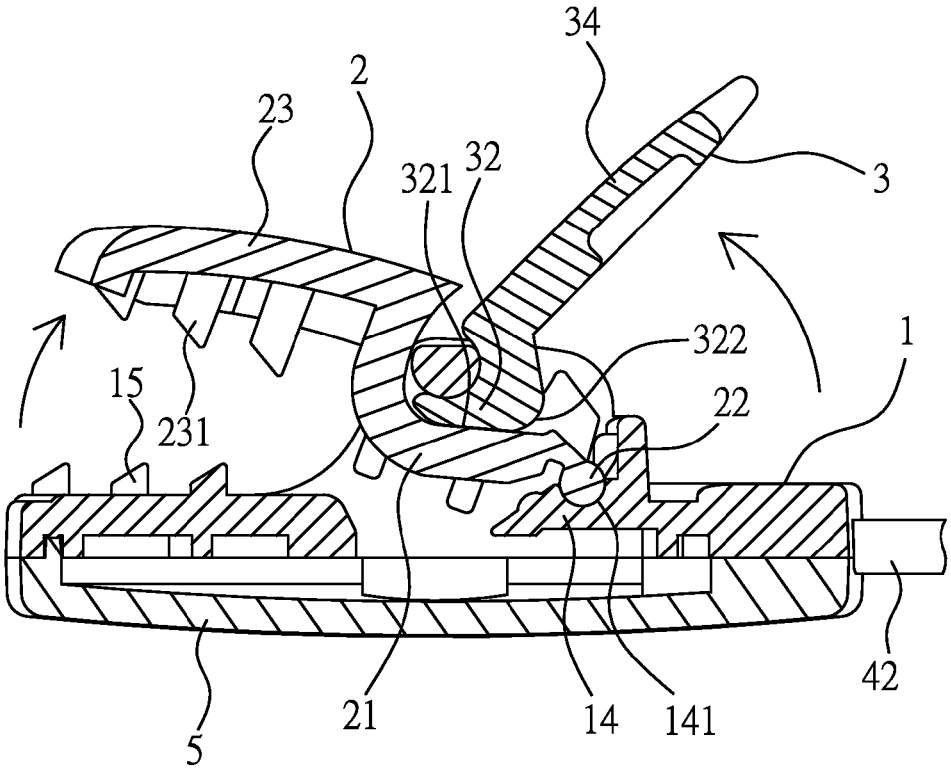
FIG. 6 is a partial cross sectional view illustrating the pacifier clip shown in FIG. 5.

As shown in FIG. 5 and FIG. 6, when the pacifier clip is desired to be released, the pulling member 3 is upwardly pulled in the counterclockwise direction, the shaft rod 12 is served as the shaft center for the rod slot 31, and the angled part 322 of the angled flange 32 is rotated along the oblique support arm 21 till the inclined cutting plane 321 is against the oblique support arm 21, so the oblique support arm 21 is no longer provided with the tightening and latching effect due to the eccentric action of the angled flange 32, so the pivotal shaft 22 received in the shaft slot 141 is served as the shaft center for the mobile clipping member 2, and the bottom sheet 14 releases energy for pushing the oblique support arm 21, the passive sheet 23 of the mobile clipping member 2 is rapidly and upwardly rotated in the clockwise direction for being raised, thereby forming a larger gap between the tooth rows 231 and the tooth lines 15 shown in FIG. 5 and FIG. 6. At this moment, the gap is enabled to be sleeved in the object to be clipped, e.g. the clothes.

Figure 7:
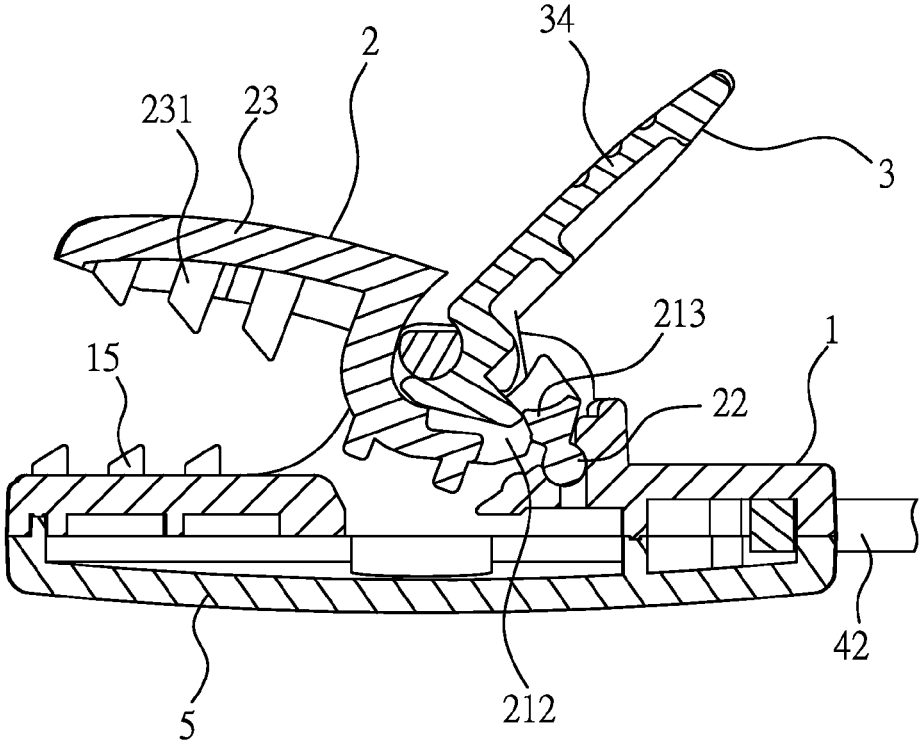
FIG. 7 is another partial cross sectional view illustrating the pacifier clip shown in FIG. 5.

As shown in FIG. 7, when the mobile clipping member 2 and the pulling member 3 of the pacifier clip are in the releasing status, the angled stop tenon 33 of the pulling member 3 is abutted against the stop piece 213 of the mobile clipping member 2, thereby serving as the limitation for the upward pulling motion of the pulling member 3 and also preventing the pulling member 3 and the mobile clipping member 2 from separating.

When a clipping operation is desired to be processed, the gap between the mobile clipping member 2 and the base sheet 1 is sleeved in an object to be clipped, e.g. the clothes, then the pulling sheet 34 of the pulling member 3 is downwardly pressed in the clockwise direction, so the inclined cutting plane 321 of the angled flange 32 is rotated along the oblique support arm 21 till the angled part 322 is abutted against the oblique support arm 21, so the oblique support arm 21 is provided with the latching effect due to the eccentric action of the angled flange 32, and the passive sheet 23 of the mobile clipping member 2 is downwardly rotated in the counterclockwise direction for being moved downwardly, thereby the tooth row 231 and the tooth lines 15 shown in FIG. 3 and FIG. 4 forming the clipping status for being clipped on the clothes.

The advantages achieved by the present invention are that: the eccentric-designed angled flange of the pulling member is able to rotate on the oblique support arm of the mobile clipping member, so the mobile clipping member is provided with functions of clipping or releasing relative to the base sheet, thereby achieving the objectives of securely clipping and anti-loosening; moreover, the present invention simplifies the components, so there is no tiny component adopted, and no complicated assembling procedure is required, thereby saving the time and labor for assembling; furthermore, the pacifier clip provided by the present invention has no metal component and the structure is strong, so the components are prevented from being broken; the present invention also complies with safety regulations established by various nations or regions, especially the European Union.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A pacifier clip, comprising:

a base sheet, the top surface thereof being protrudingly formed with a pair of sheet columns, an accommodation slot being formed between said pair of sheet columns, and the top end of the sheet columns being axially connected to a shaft rod, the bottom end of said accommodation slot being axially formed with a shaft slot, and the rear end of said base sheet being formed with one or more tooth lines;

a mobile clipping member, formed as a step-shaped sheet member, two ends of an oblique support arm formed with a hook shape in the mid portion thereof being respectively connected to a pivotal shaft received in said shaft slot and a passive sheet, the bottom surface of said passive sheet being formed with one or more tooth rows corresponding to the locations where said tooth lines being formed; and the top surface of said oblique support arm being axially and protrudingly formed with at least two ribs, and a through slot being formed between two adjacent ribs, each of said through slots being radially and protrudingly formed with a stop piece connected to said pivotal shaft;

a pulling member, the top surface at the rear end thereof being axially formed with a rod slot sleeved with said shaft rod, the bottom ends at two sides of said rod slot being protrudingly formed with a pair of angled flanges interacting with said oblique support arm, wherein the distance between an angled part at the bottom end of said pair of angled flanges and said shaft rod being greater than the distance between an inclined cutting plane at the rear end of said pair of angled flanges and said shaft rod; and the bottom surface of the pulling member between said pair of angled flanges is formed with an angled stop tenon corresponding to each through slot and having a height higher than said pair of angled flanges and penetrating into said through slot; and a tying tool, formed as an elongated member, one end thereof being fastened on said base sheet, the other end thereof being installed with a buckling ring;

when said pulling member is pulled, in the rotating motion, said angled flanges utilize an eccentric action to optionally allow said angled part or said inclined cutting plane of each angled flange to be abutted against or adjacent to said oblique support arm, so said passive sheet of said mobile clipping member is downwardly moved or upwardly raised, and said tooth rows of said passive sheet and said tooth lines of said base sheet are engaged for forming a clipping status or forming a gap in between for forming a releasing status; when said mobile clipping member is in the releasing status, each angled stop tenon is abutted against said stop piece in each through slot.

2. The pacifier clip as claimed in claim 1, wherein the bottom end of said accommodation slot is backwardly and radially protruded with a bottom sheet, said shaft slot is formed on the top surface of said bottom sheet, and one free end of said bottom sheet is formed with an inclined plane allowing said bottom surface of said oblique support arm to be abutted against while being in the clipping status.

3. The pacifier clip as claimed in claim 2, wherein two lateral sides of said bottom sheet and said pair of sheet columns are integrally combined.

4. The pacifier clip as claimed in claim 2, wherein a slit is respectively formed between two lateral sides of said bottom sheet and said pair of sheet columns, said inclined plane at the one free end of said bottom sheet is formed with a protrusion allowing said bottom surface of said oblique support arm to be elastically abutted against the bottom sheet while being in the clipping status.

5. The pacifier clip as claimed in claim 1, wherein said one or more tooth rows and said one or more tooth lines are staggeringly engaged.

6. The pacifier clip as claimed in claim 1, wherein the bottom surface of said oblique support arm is axially and protrudingly formed with a stop rib which is adjacent to the inner wall at the rear end of said accommodation slot while being in the clipping status.

7. The pacifier clip as claimed in claim 1, further including a decoration sheet having the same dimension and style as said base sheet, said decoration sheet is combined on the bottom surface of said base sheet, and the bottom surface of said decoration sheet is printed or laminated with plane patterns or directly glued with three dimensional objects.

8. The pacifier clip as claimed in claim 7, wherein proper locations on said base sheet and said decoration sheet are respectively formed with at least a ventilation hole, and said ventilation holes are communicated with each other.

9. The pacifier clip as claimed in claim 7, wherein a proper location of said base sheet is formed with a connection part, the interior of said connection part is formed with a positioning slot allowing a ring unit at the one end of said tying tool to be sleeved and a positioning tenon, and the bottom surface of said positioning tenon is longitudinally formed with an insertion hole; the top periphery of said decoration sheet is formed with a complementary connection part corresponding to the location where said connection part is formed, the interior of said complementary connection part is formed with a complementary positioning slot allowing said ring unit at the one end of said tying tool to be sleeved and an insertion tenon inserted in said insertion hole.

10. The pacifier clip as claimed in claim 1, wherein the installing location of said shaft rod is slightly lower than the top surface of said pair of sheet columns.

* * * * *